US006550522B1

(12) United States Patent
Lennon et al.

(10) Patent No.: US 6,550,522 B1
(45) Date of Patent: Apr. 22, 2003

(54) LEVEL ADJUSTER FOR WINDOW SHADES

(76) Inventors: Dennis R. Lennon, 10731 Midsummer Dr., Reston, VA (US) 20191; Richard M. Lennon, 10731 Midsummer Dr., Reston, VA (US) 20191

( * ) Notice: Subject to any disclaimer, the term of this patent is extended or adjusted under 35 U.S.C. 154(b) by 0 days.

(21) Appl. No.: 10/107,300

(22) Filed: Mar. 28, 2002

(51) Int. Cl.[7] ..... E06B 9/30
(52) U.S. Cl. ..... 160/168.1 R; 160/173 R
(58) Field of Search ..... 160/168.1 R, 172 R, 160/173 R, 176.1 R, 178.1 R, 178.2 R, 84.06, 279, 405

(56) References Cited

U.S. PATENT DOCUMENTS

| | | | | |
|---|---|---|---|---|
| 2,071,791 A | | 2/1937 | Hendricks | |
| 2,247,260 A | | 6/1941 | Stone | |
| D162,192 S | | 2/1951 | Lorentzen | |
| 2,594,806 A | | 4/1952 | Rosenbaum | |
| D168,579 S | | 1/1953 | Lorentzen | |
| 2,697,487 A | | 12/1954 | Nelson | |
| 2,868,282 A | | 1/1959 | Mason et al. | |
| 2,872,976 A | | 2/1959 | Lorentzen | |
| 3,280,890 A | * | 10/1966 | Preziosi | 160/168.1 R |
| 4,441,540 A | | 4/1984 | Tsuhako | |
| 4,557,309 A | * | 12/1985 | Judkins | 160/279 X |
| 4,623,012 A | | 11/1986 | Rude et al. | |
| 4,673,018 A | * | 6/1987 | Judkins | 160/84.06 |
| 4,722,382 A | | 2/1988 | Vecchiarelli | |
| 4,762,159 A | * | 8/1988 | Ford | 160/84.06 |
| 5,156,196 A | | 10/1992 | Corey et al. | |
| 5,531,257 A | | 7/1996 | Kuhar | |
| 6,047,760 A | * | 4/2000 | Judkins | 160/173 R |
| 6,059,004 A | * | 5/2000 | Oskam | 160/84.04 |

FOREIGN PATENT DOCUMENTS

| | | |
|---|---|---|
| EP | 413443 | 2/1991 |
| EP | 513468 | 11/1992 |
| EP | 696672 | 2/1996 |
| JP | 07-247774 | 9/1995 |

* cited by examiner

*Primary Examiner*—David M. Purol
(74) *Attorney, Agent, or Firm*—Richard C. Litman

(57) ABSTRACT

A level adjuster for window shades facilitates the level adjustment of the lower rail, in a single operation without requiring any disassembly of the installation. The adjuster comprises a clip or clamp installed in one end of a conventional hollow rail. The adjuster clip has a pair of arms and a tongue or shoe extending into the rail interior, bearing against a crossmember extending between the two arms. The draw cord or lifting line extends as a continuous length through one rail, down each side of the shade assembly, and through the opposite rail where it wraps around the adjuster crossmember and is gripped by the gripping shoe. Lower rail adjustment is accomplished by inserting a tool (nail, etc.) through a hole in the end of the adjuster to flex the resilient shoe away from the crossmember, thereby freeing the lifting line gripped between the shoe and crossmember.

20 Claims, 7 Drawing Sheets

LEVEL ADJUSTER FOR WINDOW SHADES

BACKGROUND OF THE INVENTION

1. Field of the Invention

The present invention relates generally to window blinds, cellular and other shades, and the like, and more particularly to a device and system for facilitating the adjustment of such blinds and shades when installed or maintained. The present adjuster comprises a small cord clamp which secures removably in one end of a hollow rail of such blinds and shades, and which provides for the selective release of the lifting cord which is routed therethrough, to adjust the relative lengths of the cord runs at each side of the shade in order to level the lower rail. A method of adjusting the level of the rail using the present clamp, is also disclosed.

2. Description of the Related Art

Window shades and blinds conventionally use a system of draw or lift cords or strings which connect to a lower rail and run vertically through the shade or blind structure to an upper rail, where they are routed through the upper rail to exit at one end in a group. The cord group generally terminates in a pull knob or the like, which may be grasped by the operator of the blinds or shade to raise or lower the blinds or shade as desired. Such a system is used on various types of blinds and shades, such as Venetian blinds, cellular and pleated ("accordion fold") shades, etc.

A chronic problem with such blinds and shades is the difficulty in getting the lower rail perfectly level, when the shade is installed in the window frame or casement. Conventionally, the individual lifting or draw cords pass through at least the upper panel or wall of a hollow lower rail (or perhaps through the entire rail, to exit from the bottom of the rail), with their ends passing through washers or some other small passage captured within or below the lower rail. The ends of the lifting or draw cords are knotted, with the knots serving to capture the ends of the draw cords immediately below or within the lower rail and serving to lift the lower rail when the cords are drawn upwardly as the extended cord group and/or knob is pulled. The above system is well known and conventional in the art.

While the above described system works well once it has been installed and adjusted, it is generally a rather tedious and time consuming job to adjust the lengths of the draw or lifting cords in order to make the lower rail perfectly level and/or parallel to the window sill or ledge. In the past, an installer would have to untie the lower end of at least one of the draw strings or cords, lift or lower the associated end of the lower rail, retie the draw cord, and possibly reassemble the apparatus if it was necessary to disassemble the lower rail for access to the end of the lifting cord. The installer was often not completely successful in his or her first attempt, and would have to repeat the process one or more times before finally getting the lower rail perfectly level and/or aligned with the window sill. The above described leveling process could also be used to adjust the height of the lowered shade or blind so that the lower rail is immediately adjacent, or just touching, the window sill.

The tedious and time consuming process described above, led to the development of other devices to assist in the leveling process. For example, many installations use a cord equalizer which may be adjustably positioned along the cord group extending from the upper rail. When the equalizer contacts the upper rail (or cord lock, at the point where the cord group enters the upper rail), it serves as a stop to prevent the cord from passing further into the upper rail, and thus prevents the shade from lowering further. This system results in a change of the lower rail level every time the lower rail height is adjusted, and obviously involves a considerable amount of tedious trial and error work before a satisfactory final setting is achieved which accurately positions both the height and level of the lower rail.

The above described problem has led various individuals to attempt to devise solutions, in the form of various types of fasteners, clips, etc. which install upon or within the lower rail or along the draw string line at some point. However, these devices have actually done little to truly facilitate the leveling procedure for shades and blinds, and merely require a different procedure than the older method of adjustment of the draw cord end knots. One example of such is the provision of a small clamp which must be disassembled to release the end of the draw string therefrom, and which must be reassembled to check the adjustment.

Moreover, with the popularity of "do it yourself" installations as a result of the rising costs of professional installations, more and more homeowners are attempting to install shades and blinds themselves. Conventional leveling systems are generally rather tedious and time consuming to adjust, as noted above, even for the professional installer. The typical homeowner can be completely frustrated in his or her attempts to level the lower rail of conventional blind and shade installations. They often end up calling in a professional for the adjustments, which negates much or all of the savings initially anticipated for the "do it yourself" installation, particularly where multiple installations have been made.

Accordingly, a need will be seen for a level adjuster for window shades or blinds, which allows the person making the adjustment to do so by manipulating only a single easily accessed clamp or clip. The present adjuster is installed within one end of the conventional hollow extruded metal or plastic lower rail of the shade or blinds, with the continuous run of the left and right side lifting cords passing through the device. The adjuster holds the lifting cord immovably to hold the adjustment as desired. However, when an adjustment is needed, the person making the adjustment need only release the grip of the adjuster device using a small tool, whereupon the level of the lower rail may be adjusted as desired without need to untie knots, disconnect or disassemble components or the lifting line(s), etc. Removal of the tool causes the adjuster to grip the line to hold the new adjustment as desired.

A discussion of the related art of which the applicants are aware, and its differences and distinctions from the present invention, is provided below.

U.S. Pat. No. 2,071,791 issued on Feb. 23, 1937 to Ralph T. Hendricks, titled "Venetian Blind," describes a mechanism facilitating the disassembly and reassembly of the lower rail from the rest of the assembly, so the lifting cords may be removed from the blinds and the individual slats removed from the side tapes for cleaning, replacement, etc. as necessary. However, the Hendricks mechanism provides only for the reinstallation of the lifting cords or lines in the same positions as originally installed. Hendricks does not provide any means of adjusting the length of either of the cords, much less adjusting them simultaneously using a single adjuster device, as provided by the present invention.

U.S. Pat. No. 2,247,260 issued on Jun. 24, 1941 to Abraham Stone, titled "Shade Structure For Windows And The Like," describes an accordion pleated shade configuration, with the draw cords passing through holes in each pleat or panel of the shade assembly, somewhat in the manner of the draw cord configuration of conventional Venetian blinds. Stone attaches the lower ends of the draw cords to the lower rail by passing them through the rail and knotting their distal ends. This assembly is conventional, and the prior art FIG. 7 of the present disclosure will be recognized as based upon FIG. 5 of the Stone U.S. Patent. Stone does not provide any means for easily adjusting the level of his lower rail by means of a single clamp, as provided by the present invention.

U.S. Pat. No. 2,594,806 issued on Apr. 29, 1952 to Harry S. Rosenbaum, titled "Cord And Tape Clip For Venetian Blinds," describes a construction in which the lower rail comprises a channel with an open upper area. Rosenbaum provides a pair of clips which fit into holes in the bottom wall or panel of the channel comprising the lower rail. Each clip has a keyhole slot therein, into which the knotted end of the lifting cord is installed. While this facilitates the removal of the lifting cords from the lower rail, it does nothing to ease the adjustment of the lengths of the cords to adjust the level of the lower rail, as each cord is independently knotted at its lower end. In fact, Rosenbaum teaches away from the present invention by noting that "the cord and the tape can be individually readily released from or secured to the clip without disturbing the other." (Col. 1, lines 22–25)

U.S. Pat. No. 2,697,487 issued on Dec. 21, 1954 to Harry Nelson, titled "Venetian Blind Bottom Bar," describes a built-up sheet metal bar structure for a blind or shade, in which the lifting cords are secured to the underside of the top panel. Different embodiments are provided, but each uses hooks and/or clamps stamped and bent from the material of the sheet metal top panel. As the lifting cords are gripped by these bent sheet metal hooks and/or clamps, these elements must be unbent at least to some extent each time cord length adjustment is required, thus weakening the hooks and clamps. Nelson does not teach the provision of a continuous length of cord extending up each side of the blind and adjusted by a single adjuster, as in the present invention.

U.S. Pat. No. 2,868,282 issued on Jan. 13, 1959 to Hal F. Mason et al., titled "Venetian Blind Bottom Rail And Clip," describes an assembly wherein a pair of end clips are installed over the ends of the hollow bottom rail. The end clips and bottom rail are slotted along their upper surfaces, with the slots defining a capture passage for the knotted ends of the lifting cords when the components are assembled. As in all of the shade lower bar assemblies of which the present inventors are aware, the Mason et al. assembly is cumbersome to adjust the level of the lower bar, requiring disassembly of the end components from the bar, untying the knots at the ends of the lifting cords, retying the knots as desired, reassembling the components for a trial fit, and repeating the procedure if the alignment is still not correct.

U.S. Pat. No. 2,872,976 issued on Feb. 10, 1959 to Hans K. Lorentzen, titled "Cord Lock Fitting," describes a cord lock for holding the lifting cords and their attached blinds at some height above the window sill, as desired. The Lorentzen lift cord run is essentially opposite that of the present invention, with Lorentzen stating that the lift cord is actually a single length of line extending from its two separate ends in the lower bar, through the top bar, and down to form a free end loop or bight which may be used by the operator to adjust the height of the blinds as desired. (Col. 2, lines 26–34) Lorentzen is silent regarding any level adjustment of the lower bar. However, it is clear from the above description that each cord end must be adjusted separately, unlike the present invention with its single adjuster for both cords.

U.S. Pat. No. 4,441,540 issued on Apr. 10, 1984 to Parker I. Tsuhako, titled "Bottom Rail Structural Configuration For A Venetian Blind," describes separable top and bottom rail components, with the side walls of the top component fitting between the side walls of the bottom component. The lines for the tilt adjusting lines or "slat ladder" are captured between the two walls, with the ends knotted to prevent their escape. The lifting or draw cords also have knotted ends captured within passages in the top component. As in all the other blind and shade structures discussed to this point, level adjustment of the Tsuhako blind assembly can only be accomplished by disassembling the two components, untying the knot at at least one end of the lifting cord and retying the knot as desired, reassembling the assembly and checking the level, and possibly repeating the process.

U.S. Pat. No. 4,623,012 issued on Nov. 18, 1986 to Edward T. Rude et al., titled "Headrail Hardware For Hanging Window Coverings," describes a capstan system in which a rotating rod is used to wind the lift cords thereon to lift the shade or blinds. Various details are described which provide for the winding of a single layer of cord onto the rotating rod. Length adjustment of the separate lift cords is provided by clips which secure the ends of the cords to the rod. In order to adjust the level of the lower bar or rail, the shade must be lowered completely, the upper bar or rail opened, and at least one of the clips removed and replaced to reposition the upper end of the cord, unlike the single adjustment for both sides provided by the present adjuster invention.

U.S. Pat. No. 4,722,382 issued on Feb. 2, 1988 to Francis Vecchiarelli, titled "Window Blind Assembly," describes a blind wherein the two lift cords run horizontally through the bottom rail, where they are connected together by a tension spring. The Vecchiarelli blind assembly is adapted for installation in non-vertical orientations, and includes opposite lower rail end fittings with protruding pins, which engage mating sockets in the window frame to hold the blind assembly in other than a vertical orientation. When the bottom rail is free, the spring is contracted, and the only tension on the lift cords is due to the weight of the blind assembly, with the blind assembly hanging free for lifting by the lift cords. However, when the bottom rail is secured within the frame by the pins of the two bottom rail end pieces, additional tension may be applied to the lift cords, with the spring providing a counter tension to hold the blind assembly taut within the window frame. However, Vecchiarelli does not provide any adjustment for the lengths of the two lift cords, as is clearly shown by their fixed attachment to the tension spring in FIG. 5 of the Vecchiarelli U.S. Patent. As the tension spring appears to be free within the lower rail, and the two lift cords are free to pass through guides in the top of the lower rail and thence upwardly through the blind slats, it appears that there is no means to hold a constant adjustment of the lengths of the two lift cords in the Vecchiarelli blind assembly. Certainly, no single adjustment for the two sides is disclosed by Vecchiarelli.

U.S. Pat. No. 5,156,196 issued on Oct. 20, 1992 to John Corey et al., titled "Shade Positioning And Mounting Apparatus," describes a cord locking cam for holding the lift cord and shade in a desired position, and means for attaching the head rail to an adjacent structure without need for tools or other components. No means for adjusting the lengths of the draw cords or lines is disclosed by Corey et al. It is noted that Corey et al. show their head rail system with pleated or accordion fold shades, rather than with blinds. It should be noted that the present level adjuster invention is also operable with such pleated, accordion fold, "honeycomb," and/or other styles and configurations of shades, as well as with Venetian blinds.

U.S. Pat. No. 5,531,257 issued on Jul. 2, 1996 to Otto Kuhar, titled "Cordless, Balanced Window Covering," describes a system using a series of coiled springs to apply a lifting force to the lifting cords of the blinds or shade. The lifting cords do not extend outwardly from the upper rail for manipulation by an operator for raising or lowering the shade, as in the present system. Rather, the operator merely raises or lowers the lower bar, with the springs applying the lifting force and essentially counterbalancing the weight of the assembly. While Kuhar states that multiple springs may be interconnected to provide an even lifting force to each side of the assembly, he does not disclose any means for adjusting the level of the lower bar. It would appear that such lower bar level adjustment would be cumbersome with the Kuhar shade, unlike the adjustment of the present shade.

U.S. Pat. No. D-162,192 and D-168,579, respectively issued on Feb. 27, 1951 and Jan. 6, 1953 to Hans K. Lorentzen, both titled "End Cap For A Venetian Blind Bottom Bar," both illustrate designs which apparently fit over the end of the lower bar of the blind assembly. No means is apparent in either of the Lorentzen designs for holding a lift cord therein, and/or for releasing such a lift cord held therein for adjusting the two opposite ends of the cord to level the lower bar to which they are attached, as provided by the present invention.

European Patent Publication No. 413,443 published on Feb. 20, 1991 to Hunter Douglas Industries, titled "Venetian Blinds," describes a clip which is used to secure the ladder tapes or lines to the bottom rail of a Venetian blind assembly. The '443 European Patent Publication notes the time consuming means of accomplishing this procedure using conventional techniques, which is recognized by the present inventors. However, the present invention extends beyond the manufacture of only Venetian blinds, to provide an easy means for adjusting the relative height or level of the lower bar or rail of blinds, shades, and similar window coverings at installation. Such means is not disclosed in the '443 European Patent Publication.

European Patent Publication No. 513,468 published on Nov. 19, 1992 to Aktiebolaget Sani-Maskiner, titled "Window Covering Apparatus," describes a double action or "top down, bottom up" shade, in which the upper portion comprises a series of conventionally actuated Venetian blinds and the lower portion comprises a conventional accordion pleated shade. The blinds and shade portions are separated by an intermediate bar, with the blind and shade portions being independently operable from one another. However, no disclosure is made of any form of lateral or level adjustment for either the intermediate or lower bars or rails of the window shade assembly disclosed in the '468 European Patent Publication.

Japanese Patent Publication No. 07-247,774 published on Sep. 26, 1995 to Masahiro Nagashima et al. describes (according to the drawings and English abstract) lower rail end caps having cushioning thereon. The end caps cushion the impact of the bottom rail against the floor or window sill when the blinds are lowered abruptly. No means is apparent in the '774 Japanese Patent Publication for adjusting the level of the lower rail.

Finally, European Patent Publication No. 696,672 published on Feb. 14, 1996 to Eclipse Blinds Limited, titled "Pleated Blinds," describes the construction of the lifting cords wherein the cords include a plurality of evenly spaced rungs extending laterally therefrom. The rungs support the pleats in the shade to ensure even spacing of the pleats when the shade is lowered. No means is apparent in the '672 European Patent Publication for adjusting the lengths of the lifting cords to level the lower bar.

None of the above inventions and patents, taken either singularly or in combination, is seen to describe the instant invention as claimed. Thus a level adjuster for window shades solving the aforementioned problems is desired.

SUMMARY OF THE INVENTION

The present invention is a means for quickly and easily adjusting the level of the bottom rail of a window shade or the like (blinds, etc.). The present invention provides a clip or clamp which fits into one end of a conventional hollow rail or bar (usually, but not necessarily, the lower rail) in a window shade installation. The clip has a generally U-shaped shoe or tongue which extends into the interior of the rail, and which bears against a crossmember of the clip. The single, continuous draw cord for lifting the shade or blinds extends from each side of the shade and passes through the bottom rail to pass between the clamping shoe or tongue and the crossmember of the adjuster clip, where it is held immovably in place.

When level adjustment of the lower bar is required, a small tool (e.g., nail or the like) is inserted through a hole in the base or end of the clip, and is used to lever or raise the gripping shoe away from the crossmember. This frees the draw cord, allowing the ends of the lower rail to be raised or lowered as required in order to level the rail or to align the rail with the window sill. The draw cord passes laterally back and forth through the interior of the lower rail and around the crossmember of the clip as the rail ends are relatively raised or lowered, until the rail alignment is adjusted as desired. The tool is then removed from the clip, allowing the shoe to flex back toward the crossmember to grip the draw cord immovably therebetween.

The present adjuster clip is extremely economical to manufacture, and will be seen to provide significant savings in labor time over the older conventional shade leveling procedure, in which one or both ends of the discontinuous draw cord must be accessed, untied, and retied, perhaps requiring a few repetitions before a satisfactory level alignment is achieved for the lower rail of the shade. The prior art leveling procedure can be all the more difficult, as it may be interconnected with the height adjustment of the lower rail when it is extended to its lowest position. Accordingly, the present shade rail level adjuster provides a considerable savings of time and effort over prior art lower rail leveling systems.

The present level adjuster may be economically formed of a durable plastic material, with the exposed outer portion being formed to match the opposite end cap of the rail. Alternatively, composite construction may be used, with the tongue or shoe being formed as a metal blade which is assembled with or cast integrally with the plastic end cap. Yet another alternative provides for the entire device to be stamped from a single piece of sheet metal, if so desired.

The present adjuster clip is adaptable to virtually any type of vertically raising and lowering shade or blind, whether cellular or other shades comprising one or more continuous sheets of fabric or other material, or blinds having a series of separate slats. The present adjuster may also be used with duofold type shades, having independently operable upper and lower portions.

Accordingly, it is a principal object of the invention to provide an adjuster clip or clamp for facilitating the level adjustment of the lower rail of window shades, blinds, and similar window coverings.

It is another object of the invention to provide such an adjuster clip which fits within one end of the conventional hollow lower rail of a window shade or blind installation, and which has an inwardly extending shoe or tongue which bears resiliently against a crossmember within the clip to grip the draw cord which extends therebetween.

It is a further object of the invention to provide a continuous draw cord routing extending through the upper rail, down each side of the shade assembly, and through the lower rail to wrap around the crossmember of the level adjuster.

Still another object of the invention is to provide for the quick and easy release of the grip of the adjuster on the draw cord, by inserting a tool into a passage in the adjuster end cap to release the grip of the shoe or tongue on the draw cord, thereby allowing movement of the draw cord relative to the adjuster.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention is a level adjusting device which installs within one end of the conventional hollow bar or rail (usually, but not necessarily, the lowermost rail) of a window shade assembly (blinds, accordion or other types of shades, etc.) The two lifting lines or draw cords (strings, tapes, etc.) at each end of the shade assembly, pass through the present leveling device which acts as a lock to hold the cord, and thus the lower rail through which the cord passes, in a level attitude or as desired. The two lifting lines may comprise a single, unbroken length of material threaded through the entire assembly and adjuster, or may alternatively comprise two or more lengths of cord or tape which are tied or otherwise secured together in the general center of the rail and loop through the adjuster. The present level adjuster provides quick and easy adjustment of the cord passing therethrough, and thus the level of each end of the lower rail of the shade assembly, by means of a simple tool which may be inserted into the device to release the lock.

Figure 1:
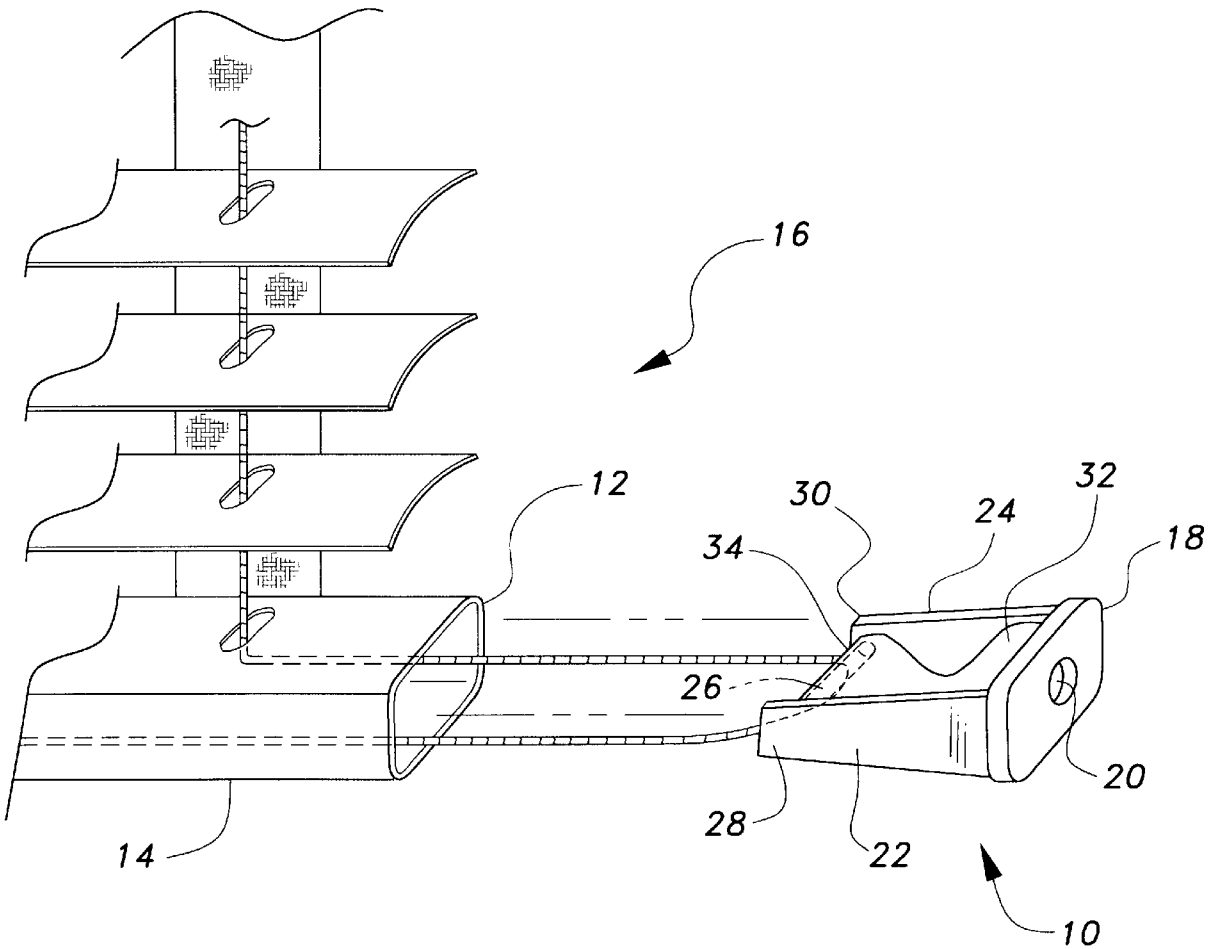
FIG. 1 is a broken away perspective view of a portion of a window blind and lower rail, showing the present adjuster in a removed position therefrom and a portion of the draw cord routing.
Figure 3:
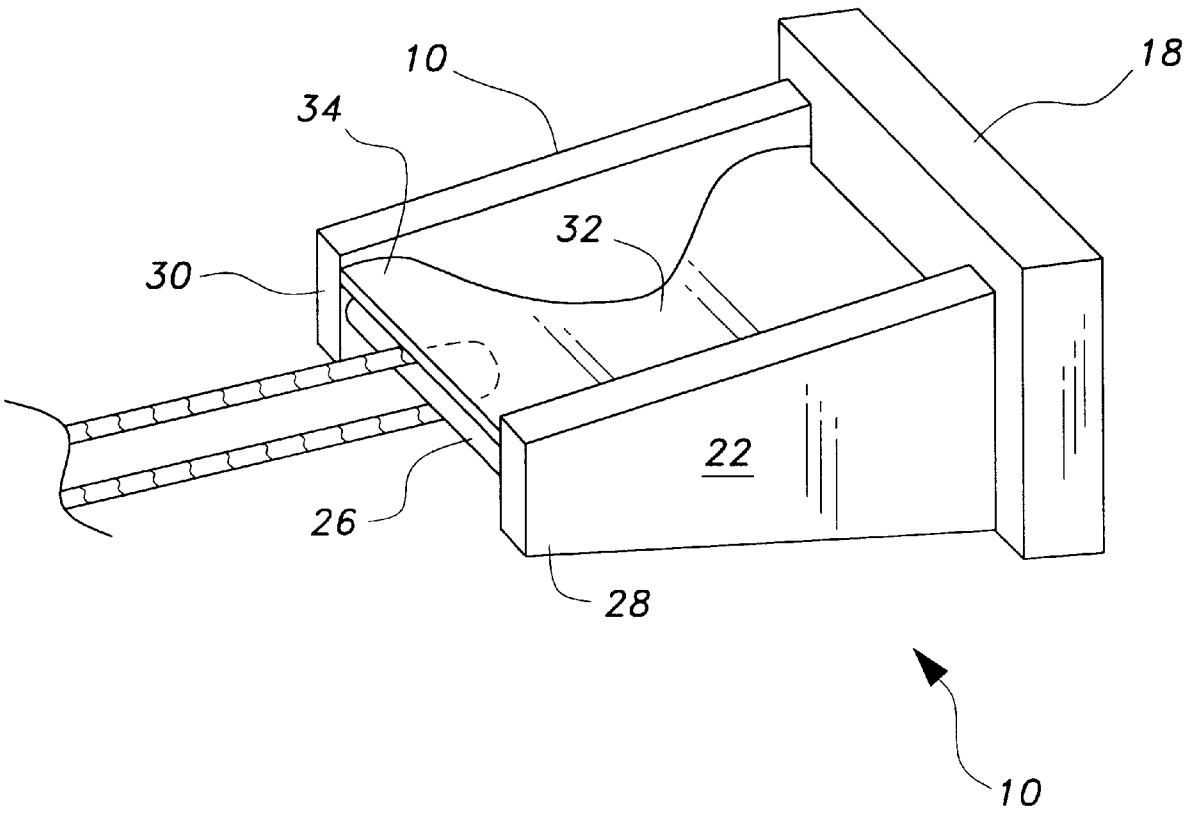
FIG. 3 is a detailed perspective view of the present adjuster device, showing details thereof and the draw cord routing therethrough.

FIGS. 1 and 3 of the drawings provide perspective views of the present window shade level adjuster 10, with FIG. 1 showing the relationship of the adjuster 10 with its installation in one end (e.g., the first end 12) of a conventional hollow bar or rail 14 of a window shade (e. g., Venetian blind) assembly 16. The rail 14 with which the present adjuster 10 is installed is typically the lowermost component of the shade assembly, but the adjuster 10 may be used with an upper or intermediate rail, if so desired.

FIG. 3 provides a more detailed view of the present adjuster 10. The adjuster 10 includes a base 18, dimensioned to closely fit and cover the otherwise open end 12 of the shade lower rail 14. The rail end cap base 18 includes an access hole or passage 20 formed therethrough (shown in FIG. 1), for reasons discussed further below. Opposite, generally parallel first and second arms, respectively 22 and 24, extend from the base 18, and provide a good fit within the hollow end 12 of the lower rail 14. A crossmember brace 26 is provided, extending between the two distal ends 28 and 30 of the two arms 22 and 24, which serves to retain the draw cord or line as it passes through the adjuster 10.

A generally U-shaped, resilient draw cord grip shoe 32 extends from the inner side of the base 18, between the two arms 22 and 24. This cord gripping shoe 32 attaches to the base 18 above the cord release hole 20, but is curved or otherwise formed to extend downwardly in front of the hole 20, with a distal cord gripping end portion 34 which turns upwardly to pass over the top of the crossmember and cord retainer 26. The two opposite lateral edges of the blade or shoe 32 are not attached to their adjacent arms 22 and 24, but have minimal clearance therebetween. This allows the blade or shoe 32 to flex upwardly and downwardly between the two arms 22 and 24 as required, while precluding slippage of the draw cord (tape, etc.) between either edge of the shoe 32 and the adjacent side arm 22 or 24. The crossmember 26 center area and/or the distal end 34 of the blade or shoe 32 may also or alternatively be relieved to hold the cord or line therein, if so desired.

The distal end portion 34 of the blade or shoe 32 bears against the crossmember bar 26 when no cord is interposed therebetween, or against the draw cord (tape, etc.) which passes around the crossmember 26, between the crossmember 26 and distal end 34 of the cord clamping blade or shoe 32. The crossmember 26 preferably has an oval or elliptical cross section, with the major axis of the oval or ellipse being parallel to the lengths of the arms 28 and 30. As most of the force developed by the draw cord extends generally parallel to the length of the rail through which the cord runs, and thus parallel to the lengths of the adjuster arms 28 and 30, this provides the additional strength needed to resist breakage due to cord tension around the crossmember 26.

The lower rail level adjuster 10 is preferably formed of a durable, resilient plastic material and cast or molded as an integral unit for ease of manufacture and economy of purchase. However, other materials (e.g., stamped sheet metal, a metal shoe molded into a plastic base, etc.) may be used alternatively.

Figure 2:
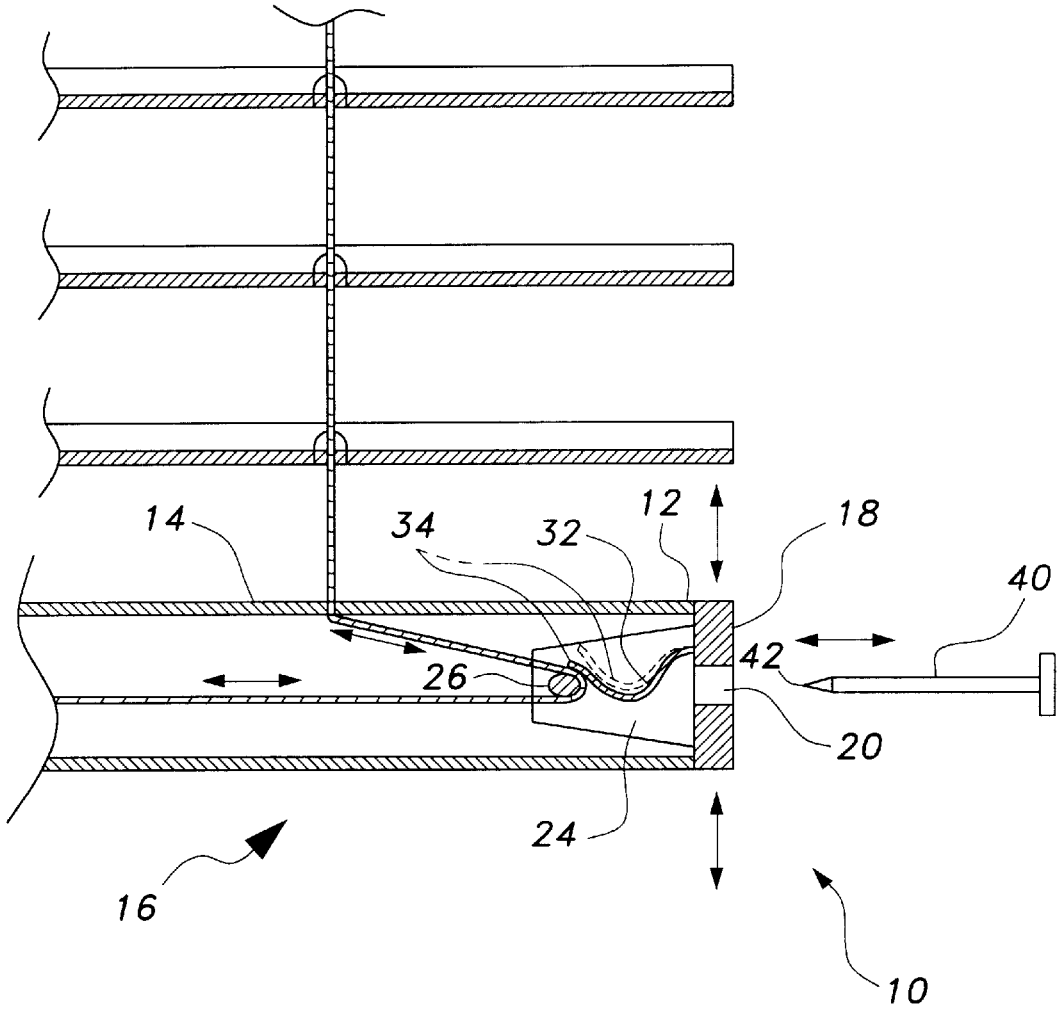
FIG. 2 is a front elevation in section of a portion of a window blind and lower rail, showing the present adjuster installed therein and means for adjusting the draw cord position.
Figure 4:
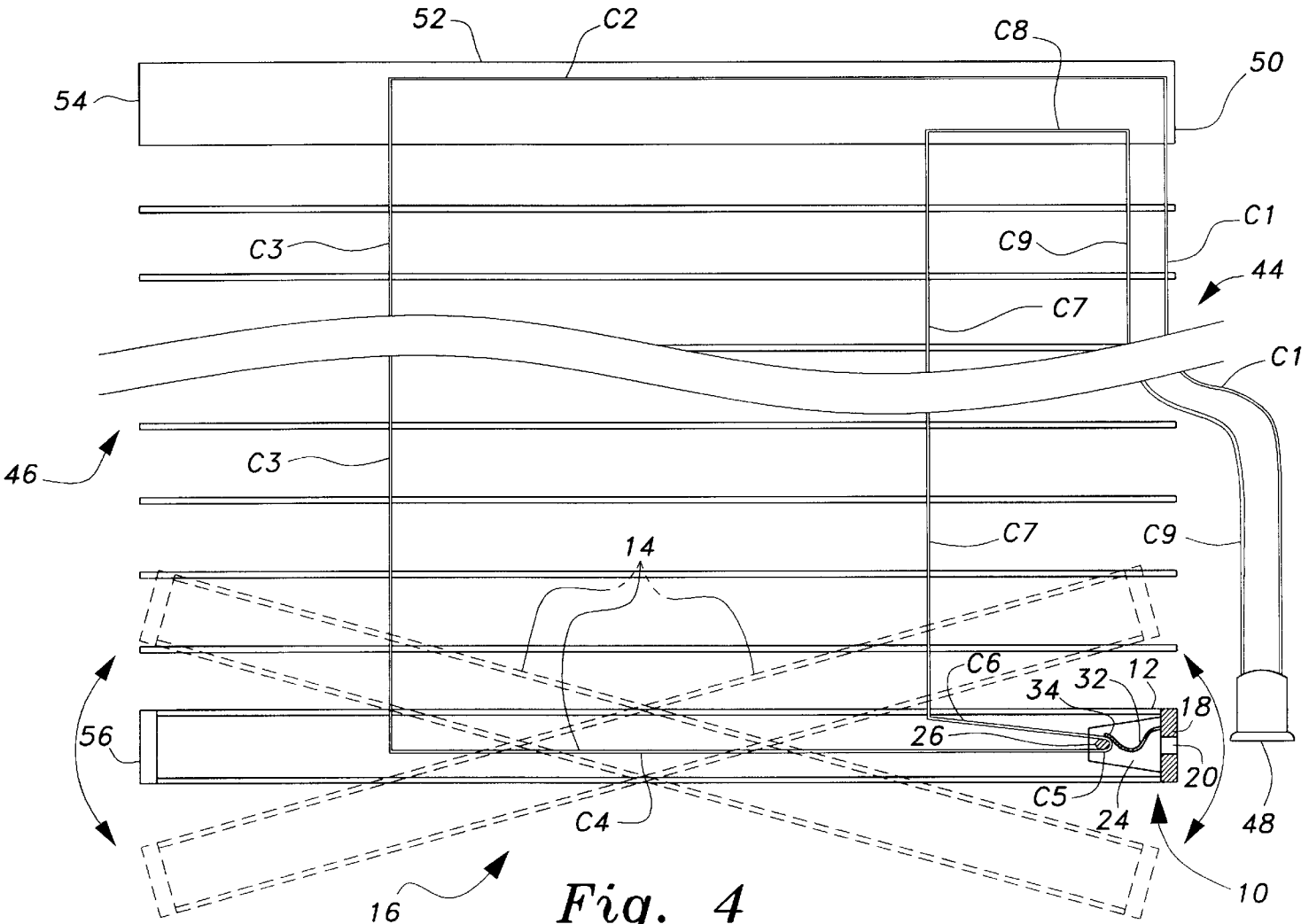
FIG. 4 is a schematic elevation view of a double draw cord window shade arrangement, showing the cord routing thereof.
Figure 5:
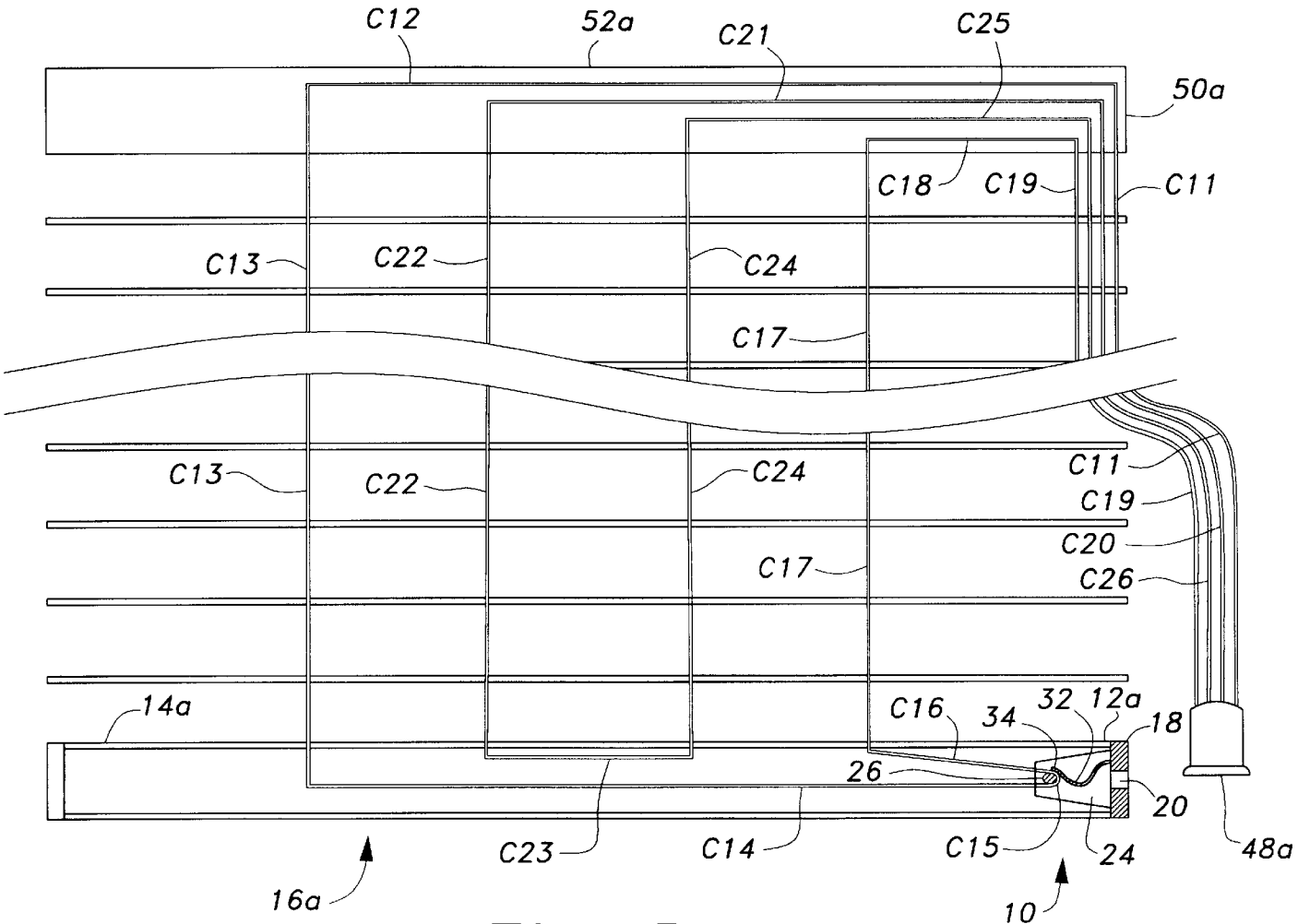
FIG. 5 is a schematic elevation view of a quadruple draw cord window shade arrangement, showing the cord routing thereof.
Figure 6:
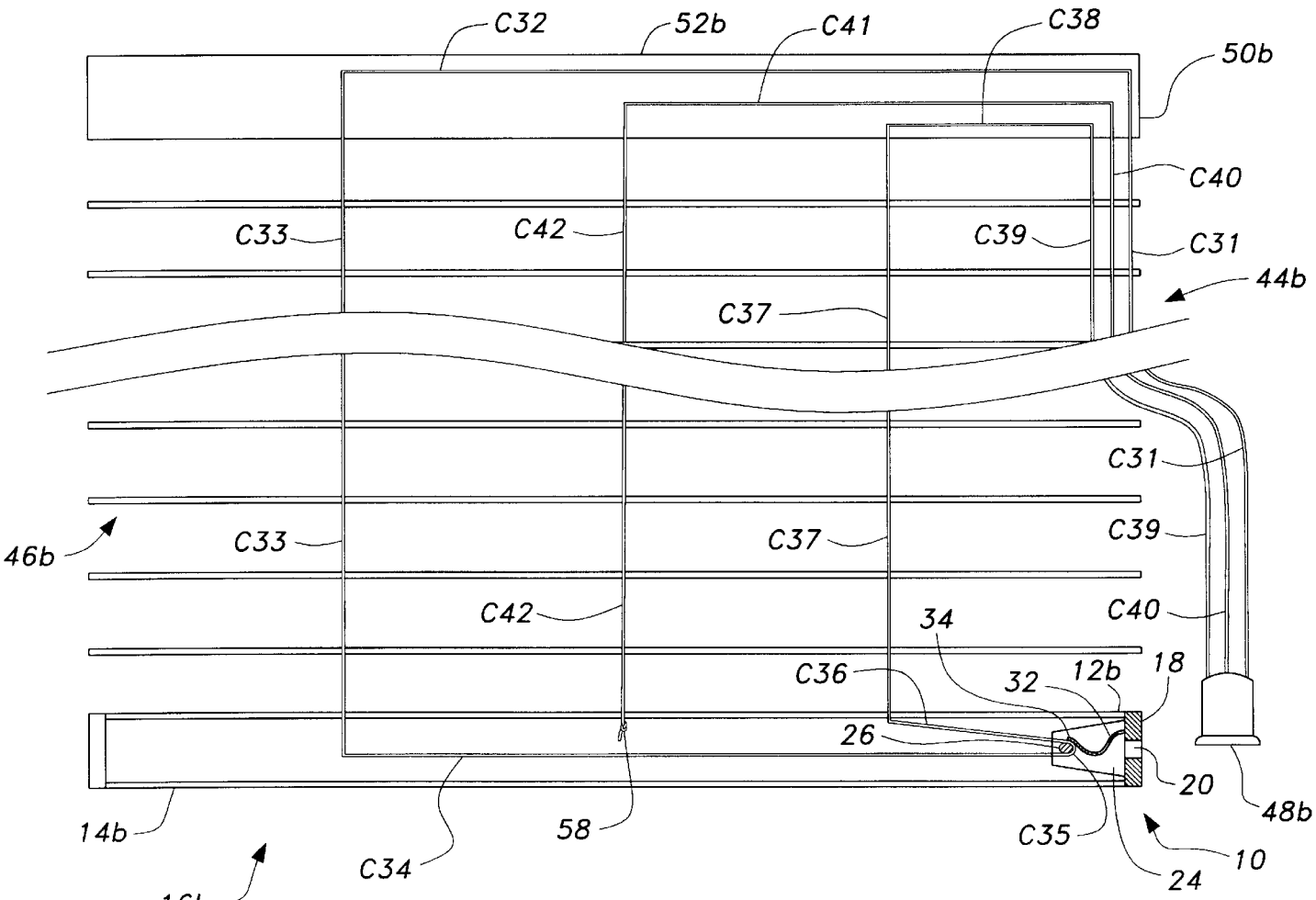
FIG. 6 is a schematic elevation view of a triple draw cord window shade arrangement, showing the cord routing thereof.

FIG. 2 is an elevation view in section, showing the installation and operation of the present adjuster within the first end 12 of the hollow lower bar or rail 14 of a window blind assembly 16. The shade or blind draw cord passes downwardly through one side of the shade or blind assembly and through at least a portion of the hollow lower bar or rail 14, and has a segment or length which passes around the adjuster crossmember 26, between the crossmember 26 and the distal end 34 of the gripping shoe 32 where it is clamped or gripped immovably between the distal end 34 of the shoe 32 and the crossmember 26. The cord then passes back through at least a portion of the lower rail 14, thence back upwardly through the opposite side of the shade or blind assembly. The cord may comprise a single unbroken length, or more practically may be formed of two or more lengths which are installed conventionally within the window shade assembly 16. One of the lengths is routed between the crossmember 26 and distal end 34 of the adjuster shoe 32, and tied or otherwise secured in series with the other length(s) of cord or tape. Installation of the present adjuster 10 is greatly facilitated by using two or more lengths of line, rather than attempting to use a single length of line. However, it will be understood that the joined line lengths in practice comprise a single draw cord or tape line, once they have been connected together. FIGS. 4 through 6, discussed further below, illustrate various draw cord arrangements with which the present adjuster may be used, but all operate essentially in the basic manner described immediately above.

It will be seen that as the adjuster shoe 32 clamps the draw cord segment immovably against the adjacent crossmember 26, that the draw cord cannot move laterally through the lower rail 14, and thus the two vertical runs of cord at each end of the blind or shade are fixed regarding their relative lengths to hold the lower rail 14 at the desired orientation. The only way the lower rail 14 may be moved is by means of the collective adjustment of the draw cord bundle or group which extends from one end of the upper rail, as is known conventionally in the art of window shades and blinds.

However, in the event that the lower rail 14 is not level, or if it is desired to change the level orientation of the lower rail, the present adjuster 10 facilitates such adjustment as desired, as shown in FIG. 2 of the drawings. In FIG. 2, a relatively long and thin grip shoe release tool 40 (nail or similar device, etc.) is removably inserted into the release pin or tool hole 20, where the distal end 42 of the tool 40 is used to press or pry against the flexible cord gripping shoe 32. Inward pressure on the tool 40, i.e., toward the opposite end of the lower rail 14, resiliently deflects the shoe 32 upwardly, causing the distal end 34 to move away from the adjacent adjuster crossmember 26 to the approximate position shown in broken lines for the distal shoe end 34 in FIG. 2. This allows the cord to move freely between the shoe 32 and the crossmember 26, thus releasing the cord and allowing it to be adjusted as desired to reposition the angle or level of the lower rail 14 as desired. When the desired level or position of the lower rail 14 has been achieved, the shoe release tool 40 is withdrawn from the tool passage 20, whereupon the distal end 34 of the grip shoe 32 flexes back downwardly toward the crossmember 26 to once again grip the cord immovably therebetween.

FIGS. 4 through 6 are schematic elevation views which illustrate various draw cord runs with which the present lower rail level adjuster 10 may be used. Blinds, shades, and the like may be supported by any number of draw cords, but only one cord which is run along each side of the shade, passes through the adjuster of the present invention to provide level adjustment of the lower rail.

In FIG. 4, a relatively simple installation includes a cord run passing through the opposite first and second sides 44 and 46 of a shade or blind assembly 16, with no intervening or additional cord runs provided. The simple, two side suspension using a single cord (or interconnected lengths in series) is sufficient for light weight shades and blinds having short lateral spans. In FIG. 4, the cord extends from a draw cord knob or pull 48, upwardly to the first end 50 of the conventional fixed position hollow upper rail 52, as cord segment or length C1. The cord then extends as cord segment C2, along the majority of the length of the upper rail 52, where it exits near the second end 54 of the upper rail 52 to travel downwardly through the second side 46 of the blinds or shade 16 as cord segment C3, where it enters the movable lower rail 14 near the second end 56 thereof.

At this point, the cord runs through the majority of the length of the lower rail 14 as cord segment C4, whereupon it passes around the adjuster crossmember 26 and beneath the distal end 34 of the cord grip shoe 32 of the adjuster 10 as cord portion C5, where it is gripped immovably therebetween. The cord then extends for a short distance back through the lower rail 14 as cord segment C6, before passing upwardly through the second side 44 of the shade 16 as cord segment C7. The cord then passes through the first side of the upper rail 52 as cord segment C8, and exits at the first end 50 of the upper rail as cord segment C9 to form a draw cord group with cord segment C1 back to the pull knob 48.

The cord lengths C1 through C9 comprise a single, continuous cord length, or cords connected together in series to form a single length, rather than two separate, parallel cords extending through each side of the shade assembly and terminating by tying off at the opposite sides of the lower rail, as is done conventionally. The cord segment lengths C2, C4, C5, C6, and C8 are fixed due to the lengths of their respective runs through the lower and upper rails 14 and 52. However, the cord lengths C1 and C9, extending from the pull knob 48, extend together as the knob 48 is pulled to shorten the two cord lengths C3 and C7 to raise the shade. The two cord lengths C1 and C9 will always be the same as one another, although those lengths will change as the shade is raised and lowered.

The two cord segments C3 and C7 which run through the opposite sides of the shade will also have identical lengths to one another, so long as the lower rail 14 is parallel to the upper rail 52. However, the relative lengths of the two cord segments C3 and C7 are adjustable relative to one another, by releasing the pressure of the cord grip shoe 32 on the cord segment C5 and adjusting the cord run through the adjuster 10. For example, if the lower rail 14 is too high at the left end, as shown by the left upper end in broken lines in FIG. 4, the respective cord segments C3 and C7 may be lengthened and shortened by inserting the tool 40 into the adjuster 10 to release the pressure of the grip shoe 32 on the cord segment C5, and adjusting the level of the lower rail 14 to cause the cord segments C4, C5, and C6 to be drawn through the lower rail 14 and adjuster 10 to reposition the rail 14 angle as desired.

Withdrawing the tool 40 from the adjuster 10, causes the gripping shoe 32 to grasp the new cord segment C5 immovably against the adjuster crossmember 26 to hold the rail 14 at the newly adjusted orientation. If the lower rail 14 is too low at the left end, as indicated by the lower left end of the rail 14 shown in broken lines in FIG. 4, it is only necessary to release the gripping pressure of the adjuster gripping shoe on the cord, and lower the opposite right end of the lower rail to raise the left end to the desired level. As with any adjustment, once the tool 40 has been withdrawn from the adjuster 10, the cord is locked in its relative position within the lower rail 14, thus holding the rail 14 in the newly adjusted position.

FIG. 5 is a schematic elevation view of an alternative blind or shade embodiment 16*a*, having a series of two separate cord lengths with a total of four vertical segments. A first cord comprises segments C11 through C19, corresponding to the cord segments C1 through C9 of the shade or blind assembly 16 of FIG. 4. The cord segment C15 is immovably gripped between the crossmember 26 and the distal end 34 of the gripping shoe 32 of the adjuster 10 installed in the first end 12*a* of the lower rail 14*a*, essentially identically to the configuration of the cord, adjuster 10, and blind or shade assembly 14 of FIG. 4. Adjustment of the lower rail 14*a* level is made in the same manner, and by the same principle, as that described above for the lower rail 14 of the assembly 16 of FIG. 4, i.e., using the tool 40 to release the grip of the shoe 32 on the cord, and adjusting the rail as desired.

However, the shade assembly 16*a* of FIG. 5 includes a second separate cord, extending from the pull knob 48*a* as segment C20, through the fixed upper rail 52*a* as cord segment C21, downwardly through the shades or blinds between the two cord segments C13 and C17 of the first cord as cord segment C22, and across the central portion of the lower rail 14*a* as cord segment C23. From this point, the second cord continues back up through the central area of the shades or blinds as cord segment C24, across the fixed upper rail 52*a* as cord segment C25 to exit from the first end 50*a* thereof, to extend outwardly therefrom as cord segment C26, joining the other three cord segments C11, C19, and C20 to form a pull cord group for the shade or blind assembly 16*a*.

It should be noted that the second cord, comprising cord segments C20 through C26, does not provide any level adjustment for the lower rail 14*a* of the assembly 16*a* of FIG. 5. Rather, the second cord only provides support for the central area of the lower rail 14*a*, and is useful in relatively large shade and blind installations having wide spans. This cord segment C23, and the lower ends of the two second cord vertical segments C22 and C24, are free to move back and forth into, through, and from the central area of the lower rail 14*a* as the rail 14*a* is adjusted for level or tilt. Thus, only a single cord length, i.e., the first cord comprising segments C11 through C19, need pass through the adjuster 10. This enables all lower rail level adjustment of a larger, multiple cord shade assembly 16*a* to be made using a single adjuster 10 installed in one end of the rail 14*a*, as shown in FIG. 4.

FIG. 6 illustrates yet another window shade or blind assembly embodiment which may make use of the present level adjuster. The window shade or blind assembly 16*b* of FIG. 6 is intermediate in size between the smaller assembly 16 of FIG. 4 and the larger assembly of FIG. 5, and requires only a single centrally disposed second cord in addition to the first cord, which has a path essentially the same as that of the cord of the assembly of FIG. 4 and the first cord of the assembly of FIG. 5. In FIG. 6, the first cord extends from the pull knob 48*b* upwardly to the first end 50*b* of the fixed upper rail 52*b*, as cord segment C31. The first cord continues through the hollow upper rail 52*b* as cord segment C32, and extends downwardly through the first side area 46*b* of the assembly 16*b* as cord segment C33.

The cord then passes through the hollow interior of the lower rail 14*b* as cord segment C34, with the first end of this segment extending between the crossmember 26 and the distal end 34 of the cord gripping shoe 32 of the level adjuster 10 as gripped cord segment C35. The cord then continues back through the lower rail 14*b* as cord segment C36, and upwardly through the right side area 44*b* of the shade assembly 16*b* as cord segment C37. The cord then enters the upper rail 52*b* and extends horizontally back to the first end 50*b* thereof as cord segment C38, where it exits and extends downwardly to the pull knob 48*b* as first cord segment C39.

In addition, the window shade assembly 16*b* of FIG. 6 includes a second cord supporting the center of the lower rail 14*b*. The second cord extends upwardly from the pull knob 48*b* as cord segment C40, where it enters the right end 50*b* of the upper rail 52*b* and continues horizontally therethrough as cord segment C41. The second cord leaves the upper rail 52*b* at its general center, and extends downwardly as cord segment C42 where its distal end 58 is secured within or beneath the center of the first rail 16*b* by a knot or other suitable means. While the second cord is affixed to the lower rail 14*b*, its attachment point acts as a fulcrum, which allows level adjustment to be made to either side thereof using the single adjuster 10 installed in the first end 12*b* of the lower rail 14*b*, as described above for the embodiments of FIGS. 4 and 5.

Figure 7:
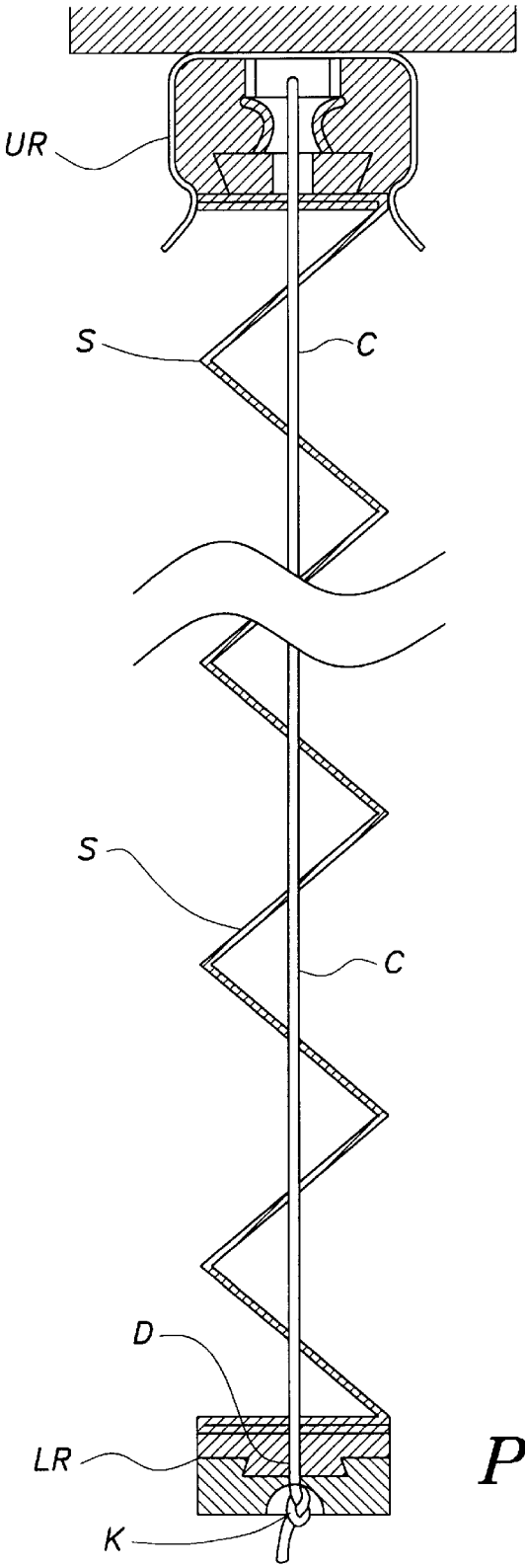
Fig. 7 PRIOR ART
FIG. 7 is an end elevation in section of a prior art window shade construction, showing the knotted end of one of the draw cords as used to adjust the lengths of the draw cords in prior art shades and blinds.

FIG. 7 is a cross section elevation view of a prior art blind or shade assembly, comprising a lower rail LR, an upper rail UR, and a series of accordion folded or pleated shade segments S disposed therebetween. (The present invention may be used with such accordion fold shades as well as with other types of shades, with the prior art shade configuration of FIG. 7 incorporated herein by reference.) A draw cord C extends from a lowermost distal end D, where it is secured with a knot K to hold that distal end D within the lower rail LR. The upper portion of the draw cord C passes through a conventional guide and extends through the upper rail UR and outwardly therefrom in a draw cord group, similarly to the arrangement used through the upper rails of the various embodiments of the window shade assemblies disclosed herein.

It will be noted that the conventional attachment of the lower or distal end D of the draw cord C, requires that the knot K be untied and retied according to the judgment of the person making the adjustment(s) to the prior art window shade of FIG. 7. As at least two such cords are always provided in such installations, the person making the adjustment is faced with a tedious and time consuming project, in perhaps having to untie and retie the knot(s) on at least one, or perhaps two or more, cords, in order to eventually arrive at a level installation for the lower rail LR. It should also be noted that this conventional leveling process is also inextricably combined with the height adjustment for the shades or blinds, thus further increasing the difficulty. While this is tedious and time consuming for a single window, it will be appreciated that a professional installation, perhaps encompassing blind or shade installations for an entire home or office, will involve an inordinate amount of time, and therefore labor expense.

The present level adjuster permits the person making the adjustment to do so merely by releasing the pressure of the gripping shoe against the single cord segment passing around the crossmember, and leveling the lower rail as desired, with the cord passing freely around the crossmember and beneath the adjuster gripping shoe of the adjuster. Once the desired level is achieved, the release tool is removed from the adjuster to lock the draw cord segment between the gripping shoe and the crossmember of the adjuster, to hold the lower rail alignment as desired. The height adjustment is a separate operation.

In conclusion, the present level adjuster for blinds and shades greatly facilitates the level adjustment of the lower rail of such installations. The present level adjuster is extremely versatile, and may be installed in virtually any type of blind or shade assembly which uses a series of vertically disposed draw cords to raise and lower the lower rail of the assembly. For example, the present level adjuster may be used with otherwise conventional Venetian blind installations, or with pleated or accordion style shades, as depicted in the prior art of FIG. 7.

The present adjuster may also be used with dual type shades or blinds, in which two separate shade or blind areas are combined one above the other in a single window. An example of such an assembly is disclosed in European Patent Publication No. 513,468 published on Nov. 19, 1992 to Aktiebolaget Sani-Maskiner, titled "Window Covering Apparatus (discussed further above in the discussion of the related art), which disclosure is incorporated herein by reference. The present adjuster may be installed in both the lowermost rail and also in the intermediate rail, to provide level adjustment for both movable rails of such a window shade configuration. Other types of window shades with which the present adjuster may be used, include conventional honeycomb shade construction, wherein the shade is formed of a series of horizontal cells, "balloon" shade configurations, and others using similar draw cord arrangements. In short, the present level adjuster is adaptable to virtually any type of window blind or shade assembly which includes a vertically positionable lower rail.

While the present disclosure has described the use of the present level adjuster with manually operated blind or shade lifting mechanisms, it will be seen that it is also adaptable for use with mechanized or motorized blind or shade lifting mechanisms as well. The installation of the present level adjuster in the movable lower rail (and/or intermediate rail, where such is provided) greatly reduces the amount of time, and therefore labor costs, involved in accurately aligning the lower (and/or intermediate) rail(s) in a window blind or shade installation, thus greatly reducing the cost of such an installation. While the present disclosure has primarily described the adjuster of the present invention as being installed in one end of the lowermost rail, it will be seen that the adjuster may be installed in the uppermost rail, with the cord routing arranged accordingly, if so desired. However, placement in the lowermost rail is preferred, for ease of access. The present adjuster provides an economical and easy means for the home installer to adjust his or her window shades or blinds after installation, thereby eliminating the need for hours of frustrating adjustments with knotted draw cords, or the need to call in professional assistance and the associated costs involved. The present level adjuster will thus find widespread popularity among both amateurs and professionals in the field of window shades, blinds, and coverings.

It is to be understood that the present invention is not limited to the embodiments described above, but encompasses any and all embodiments within the scope of the following claims.

We claim:

1. In a window shade assembly having at least a hollow, fixed upper rail, a hollow, movable lower rail, and a window shade structure extending therebetween controlled by at least one lifting line extending through and between the upper rail and the lower rail, a level adjuster for the window shade, comprising:

a rail end cap base;

opposed, generally parallel first and second arms extending from said base;

each of said arms having a distal end;

a crossmember extending between said distal end of each of said arms;

a resilient gripping shoe extending from said base and between said arms;

said gripping shoe having a distal portion disposed immediately adjacent the crossmember, and gripping the lifting line between said distal portion of said gripping shoe and said crossmember when said level adjuster is installed within an end of a rail; and said base further including an access hole formed therethrough for removably inserting a gripping shoe release tool therein for urging said gripping shoe away from said crossmember, thereby releasing the grip of said gripping shoe on the lifting line against said crossmember for the adjustment of the lifting line and corresponding level adjustment of the lower rail.

2. The level adjuster according to claim 1, wherein said gripping shoe has a generally U-shaped configuration.

3. The level adjuster according to claim 1, further including an elongate gripping shoe release tool for removably inserting into said access hole for temporarily releasing the grip of said gripping shoe on the lifting line.

4. The level adjuster according to claim 1, wherein said base, said arms, said crossmember, and said gripping shoe are all formed of a durable plastic material.

5. A window shade assembly and level adjuster therefor, comprising in combination:

a hollow, fixed upper rail having opposed first and second ends;

a hollow, movable lower rail having opposed first and second ends;

an adjustably movable window shade structure having a first side and a second side, and extending between said upper rail and said lower rail;

at least one lifting line extending through and between said upper rail and said lower rail;

a level adjuster disposed in one of said ends of one said rail;

said level adjuster including a rail end cap base;

opposed, generally parallel first and second arms extending from said base of said level adjuster;

each of said arms of said level adjuster having a distal end;

a crossmember extending between said distal end of each of said arms of said level adjuster;

a resilient gripping shoe extending from said base and between said arms of said level adjuster;

said gripping shoe having a distal portion disposed immediately adjacent said crossmember, and gripping said lifting line between said distal portion of said gripping shoe and said crossmember when said level adjuster is installed within one of said ends of one said rail; and said base further including an access hole formed therethrough for removably inserting a gripping shoe release tool therein for urging said gripping shoe away from said crossmember, thereby releasing the grip of said gripping shoe on said lifting line against said crossmember for the adjustment of said lifting line and corresponding level adjustment of said lower rail.

6. The window shade assembly and level adjuster combination according to claim 5, wherein said gripping shoe of said level adjuster has a generally U-shaped configuration.

7. The window shade assembly and level adjuster combination according to claim 5, wherein said base, said arms, said crossmember, and said gripping shoe of said level adjuster are all formed of a durable plastic material.

8. The window shade assembly and level adjuster combination according to claim 5, further including an elongate gripping shoe release tool for removably inserting into said access hole of said level adjuster for temporarily releasing the grip of said gripping shoe on said lifting line.

9. The window shade assembly and level adjuster combination according to claim 5, further including an elongate gripping shoe release tool for removably inserting into said access hole of said level adjuster for temporarily releasing the grip of said gripping shoe of said level adjuster on said lifting line.

10. The window shade assembly and level adjuster combination according to claim 5, wherein said lifting line is selected from the group consisting of draw cords, strings, and tapes.

11. The window shade assembly and level adjuster combination according to claim 5, wherein said lifting line comprises a single length extending from an external lifting line group across through said upper rail, downwardly through said first side of said window shade structure, across through said lower rail, around said crossmember of said level adjuster, through said lower rail, upwardly through said second side of said window shade structure, and through said upper rail, joining with said lifting line group.

12. The window shade assembly and level adjuster combination according to claim 5, wherein said lifting line comprises:

a single first length extending from an external lifting line group across through said upper rail, downwardly through said first side of said window shade structure, across through said lower rail, around said crossmember of said level adjuster, through said lower rail, upwardly through said second side of said window shade structure, and through said upper rail, joining with said lifting line group; and a second length extending from said lifting line group through said upper rail and downwardly therefrom through said window shade structure between said first side and said second side thereof, with a distal end secured to said lower rail.

13. The window shade assembly and level adjuster combination according to claim 5, wherein said lifting line comprises:

a single first length extending from an external lifting line group across through said upper rail, downwardly through said first side of said window shade structure, across through said lower rail, around said crossmember of said level adjuster, through said lower rail, upwardly through said second side of said window shade structure, and through said upper rail, joining with said lifting line group; and a single second length extending from said lifting line group through said upper rail and downwardly therefrom through said window shade structure between said first side and said second side thereof, across said lower rail, back upwardly through said window shade structure, and across said upper rail, joining with said lifting line group.

14. The window shade assembly and level adjuster combination according to claim 5, wherein said window shade structure comprises a plurality of Venetian blinds.

15. The window shade assembly and level adjuster combination according to claim 5, wherein said window shade structure comprises an accordion fold shade.

16. The window shade assembly and level adjuster combination according to claim 5, wherein said window shade structure comprises:

an upper portion;

a lower portion;

an intermediate rail disposed between said upper portion and said lower portion; and each said portion being independently operable by means of a plurality of said lifting lines.

17. The window shade assembly and level adjuster combination according to claim 5, wherein said window shade structure comprises a conventional honeycomb shade configuration.

18. A method for adjusting the level of the lower rail of a window shade assembly, comprising the following steps:

(a) providing a window shade assembly having a hollow, fixed upper rail with opposed first and second ends, a hollow, movable lower rail with opposed first and second ends, an adjustably movable window shade structure having a first side and a second side and extending between the upper rail and the lower rail, and at least one lifting line extending through and between the upper rail and the lower rail;

(b) further providing a level adjuster including means for adjustably securing the lifting line therein;

(c) passing the lifting line through the window shade assembly and through the level adjuster, and gripping the lifting line within the level adjuster;

(d) installing the level adjuster in one of the ends of one of the rails;

(e) selectively releasing the grip of the level adjuster on the lifting line, and allowing the lifting line to pass linearly through the level adjuster;

(f) leveling the lower rail of the window shade assembly as desired; and (g) engaging the grip of the level adjuster on the lifting line, thereby locking the level of the lower rail as desired.

19. A method for adjusting the level of the lower rail of a window shade assembly according to the method of claim 18, further including the steps of:

(a) configuring the level adjuster with a rail end cap base having an access hole therethrough, opposed and generally parallel first and second arms extending from the base, a crossmember extending between the distal ends of the arms, and a resilient gripping shoe extending from the base and between the arms, with the gripping shoe having a distal portion disposed immediately adjacent the crossmember;

(b) routing the lifting line between the crossmember and the gripping shoe of the level adjuster, and gripping the level line therebetween;

(c) providing an elongate gripping shoe release tool;

(d) inserting the gripping shoe release tool into the access hole of the base of the level adjuster and levering the gripping shoe away from the crossmember, thereby releasing the grip of the gripping shoe on the lifting line;

(e) adjusting the level of the lower rail and allowing the lifting line to pass between the crossmember and the gripping shoe of the level adjuster as required; and (f) removing the gripping shoe release tool from the access hole in the base of the level adjuster, thereby gripping the level line immovably between the crossmember and the gripping shoe of the level adjuster and holding the lower rail level as adjusted.

20. A method for adjusting the level of the lower rail of a window shade assembly according to the method of claim 18, further including the steps of:

(a) providing a lifting line group extending freely from the upper rail of the window shade assembly; and (b) routing the lifting line from the lifting line group through a portion of the upper rail, downwardly through the window shade structure adjacent the second side thereof, through a portion of the lower rail to one end thereof, through the level adjuster, back through the lower rail, upwardly through the window shade structure adjacent the first side thereof, and back through the upper rail to rejoin the lifting line group.

* * * * *